United States Patent [19]

Anderson

[11] 4,380,304

[45] Apr. 19, 1983

[54] CONTAINER HAVING AN INTEGRAL HANDLE AN A CLOSURE

[76] Inventor: George C. Anderson, 212 Coventry Pl., Mt. Prospect, Ill. 60056

[21] Appl. No.: 290,200

[22] Filed: Aug. 5, 1981

[51] Int. Cl.[3] ..... B65D 41/16; B65D 41/18

[52] U.S. Cl. ..... 220/306; 220/307; 220/94 A; 215/DIG. 1

[58] Field of Search ..... 220/306, 307, 94 A; 150/0.5; 215/100, DIG. 1

[56] References Cited

U.S. PATENT DOCUMENTS

| | | | |
|---|---|---|---|
| 3,369,690 | 2/1968 | Hayes | 220/94 A |
| 3,730,382 | 5/1973 | Heisler | 220/94 A |
| 4,079,857 | 3/1978 | Crisci | 220/306 |
| 4,234,100 | 11/1980 | Chabot | 220/306 |

*Primary Examiner*—George T. Hall

[57] ABSTRACT

The present invention relates to an improved container construction including a molded resilient plastic vessel having one open end and a molded resilient plastic cover removably and sealingly mountable on the open end of the vessel for containing materials, including liquids, in the vessel. The molded resilient plastic vessel includes a right circular cylindrical wall having a bottom formed integral with the interior of the wall adjacent to one end leaving the opposite end of the wall open. A handle assembly is formed integral with the exterior of the cylindrical wall adjacent to the open end. The handle assembly includes an arcuate handle having opposite ends formed integral with the cylindrical wall. The vessel includes a top seal defining the open end. The top seal includes a bead formed integral with the outer surface of the cylindrical wall and a top surface defining the open end of the vessel. The bead has a side and a lower locking face. The lower locking face is on the bead adjacent to the bottom. The cover includes a substantially flat circular top having a cover seal formed integral with the outer periphery of the top.

32 Claims, 10 Drawing Figures

FIG. 1
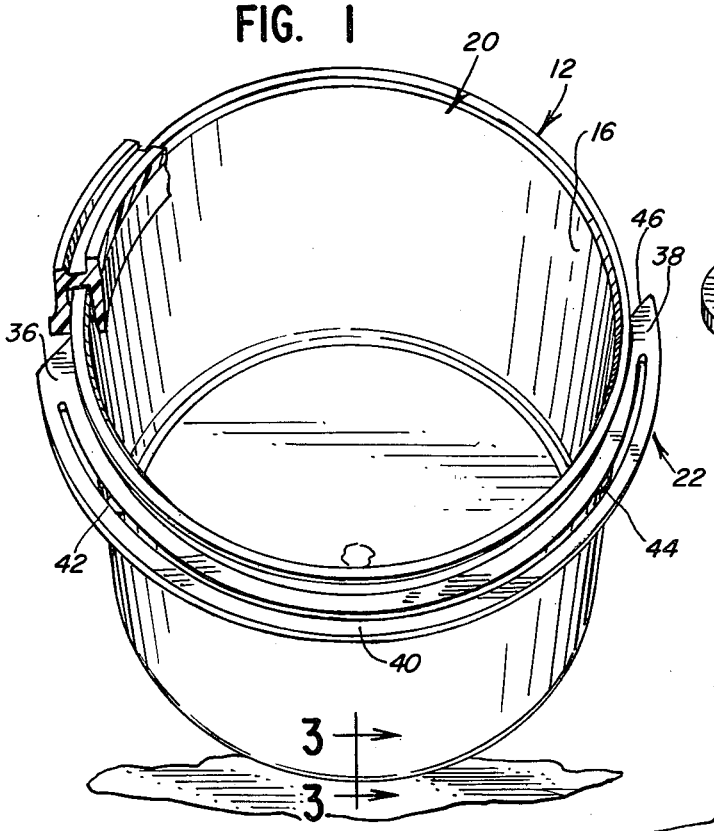
FIG. 2
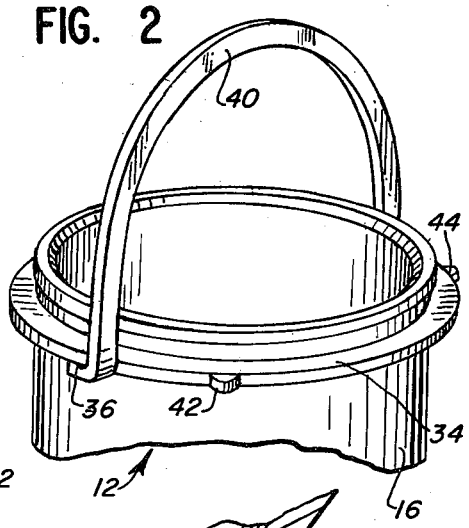
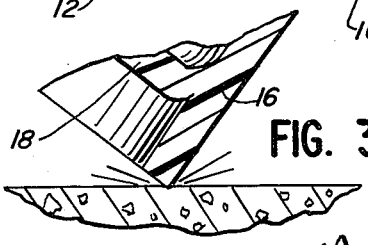
FIG. 3
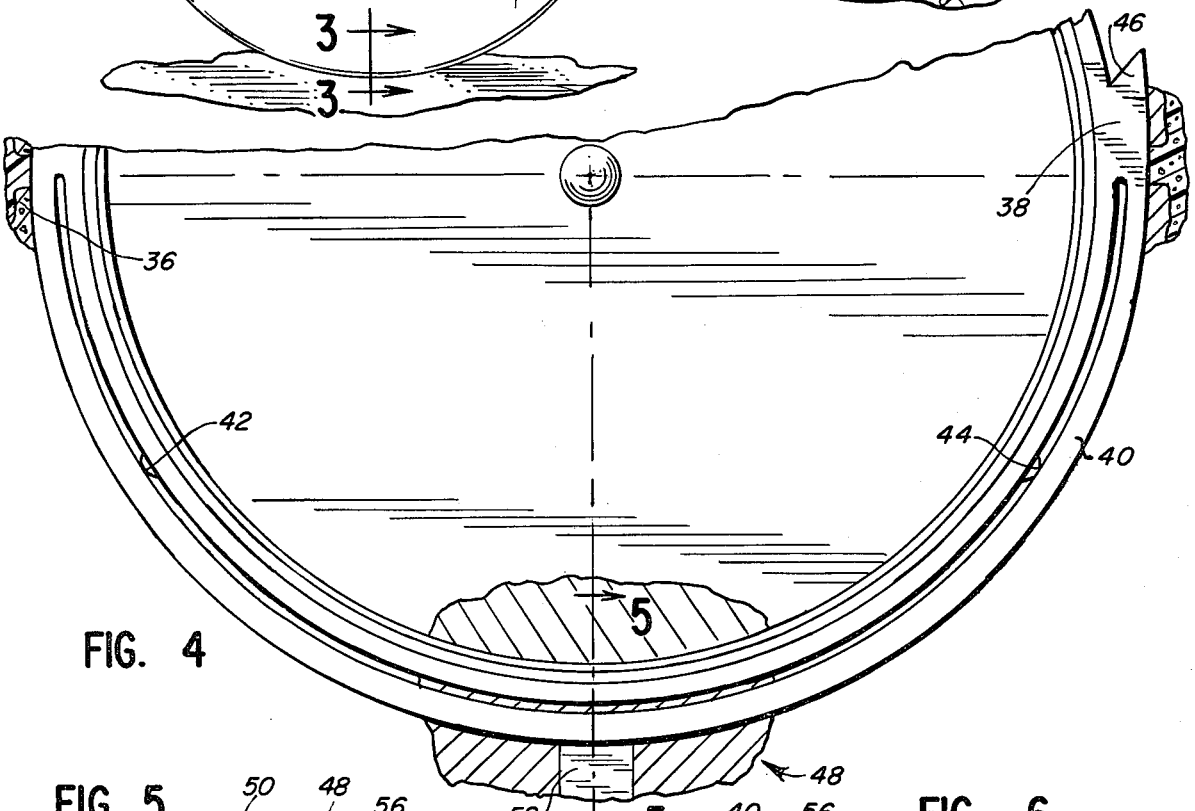
FIG. 4
FIG. 5
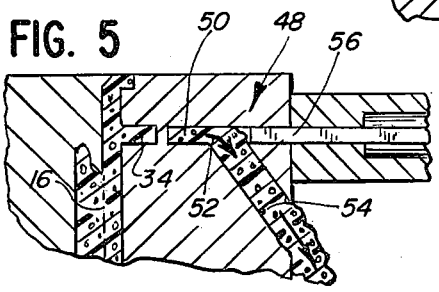
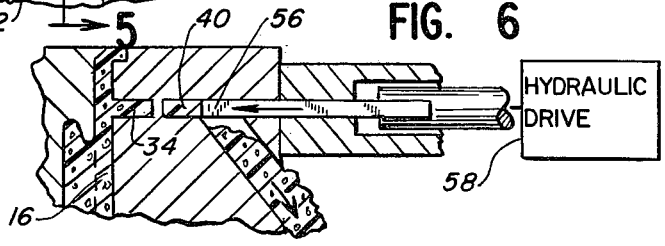
FIG. 6

FIG. 7
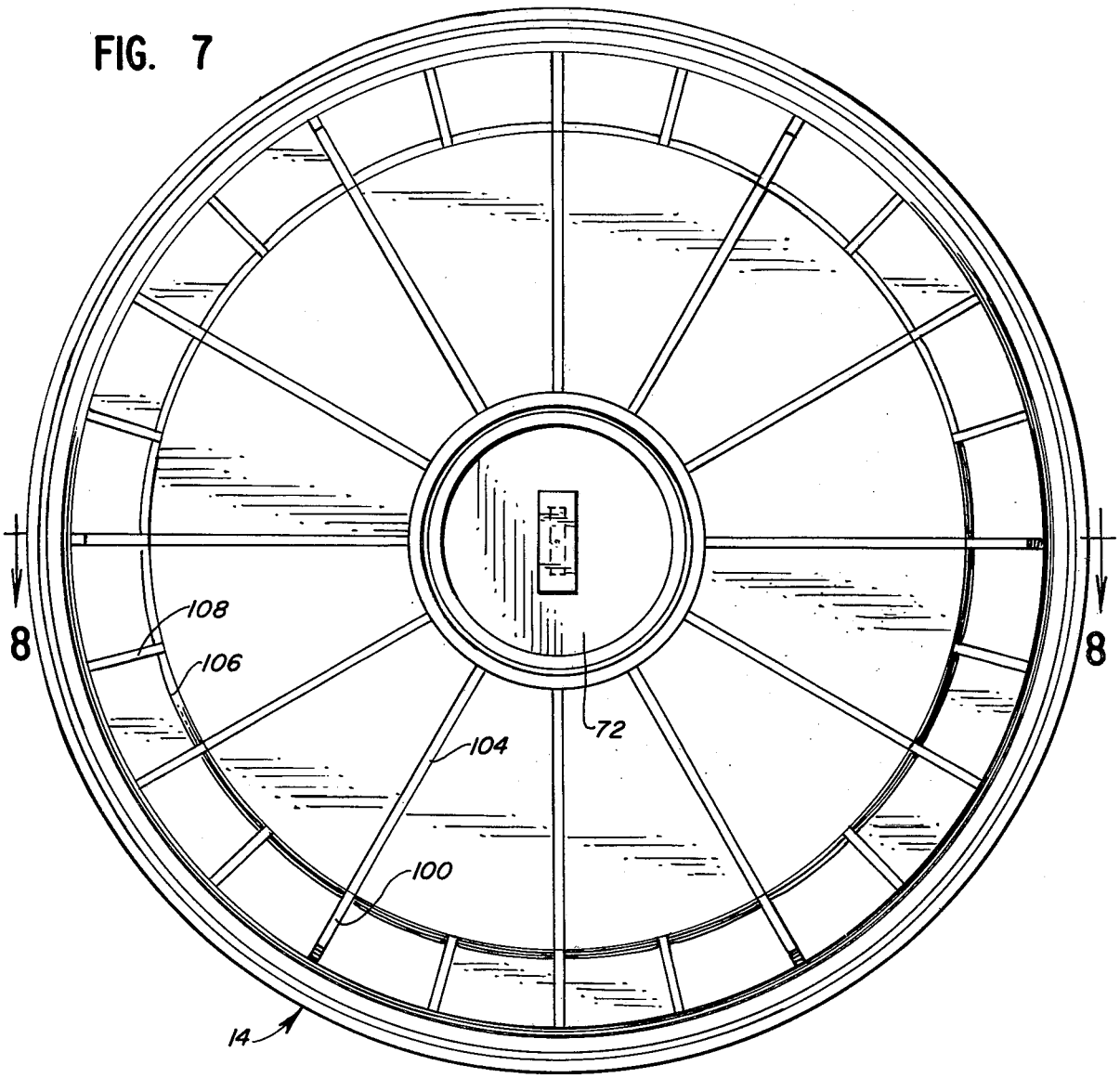
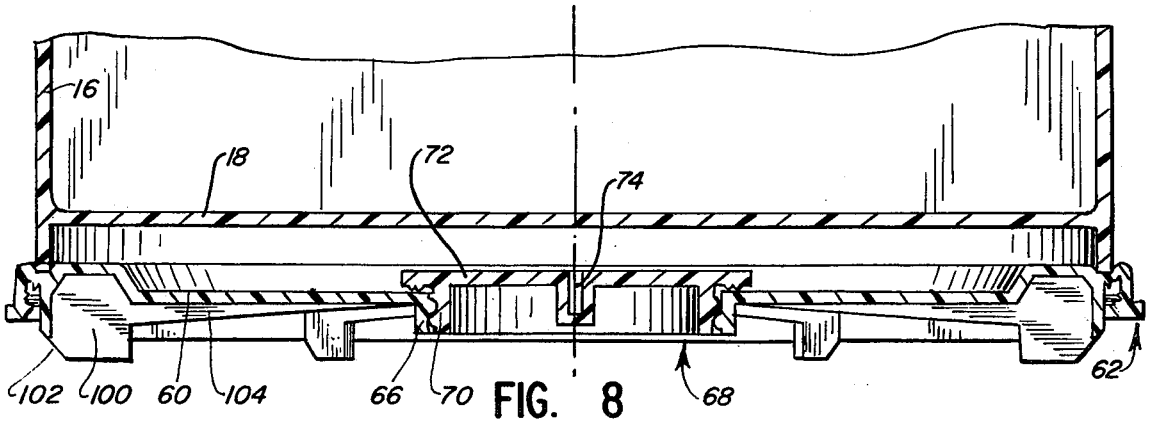
FIG. 8

FIG. 9
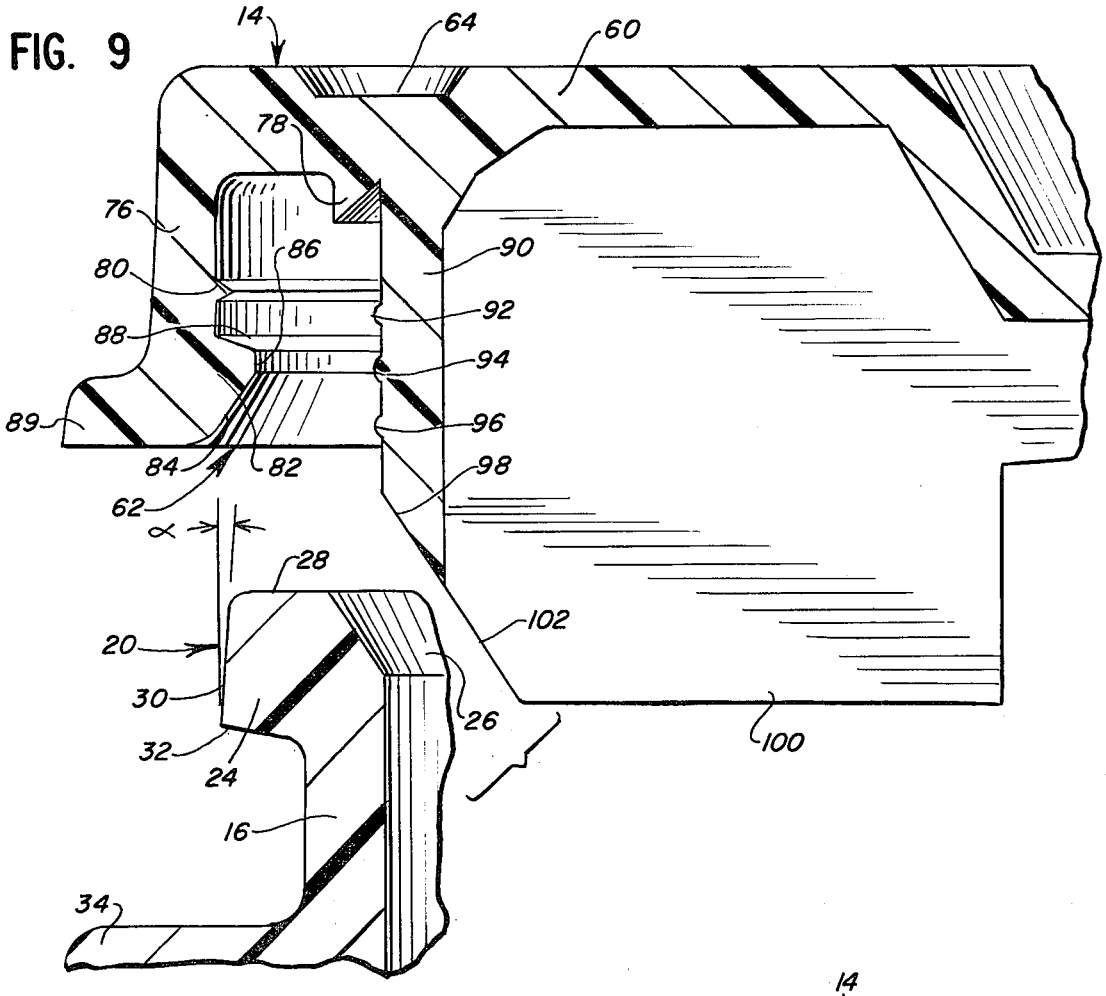
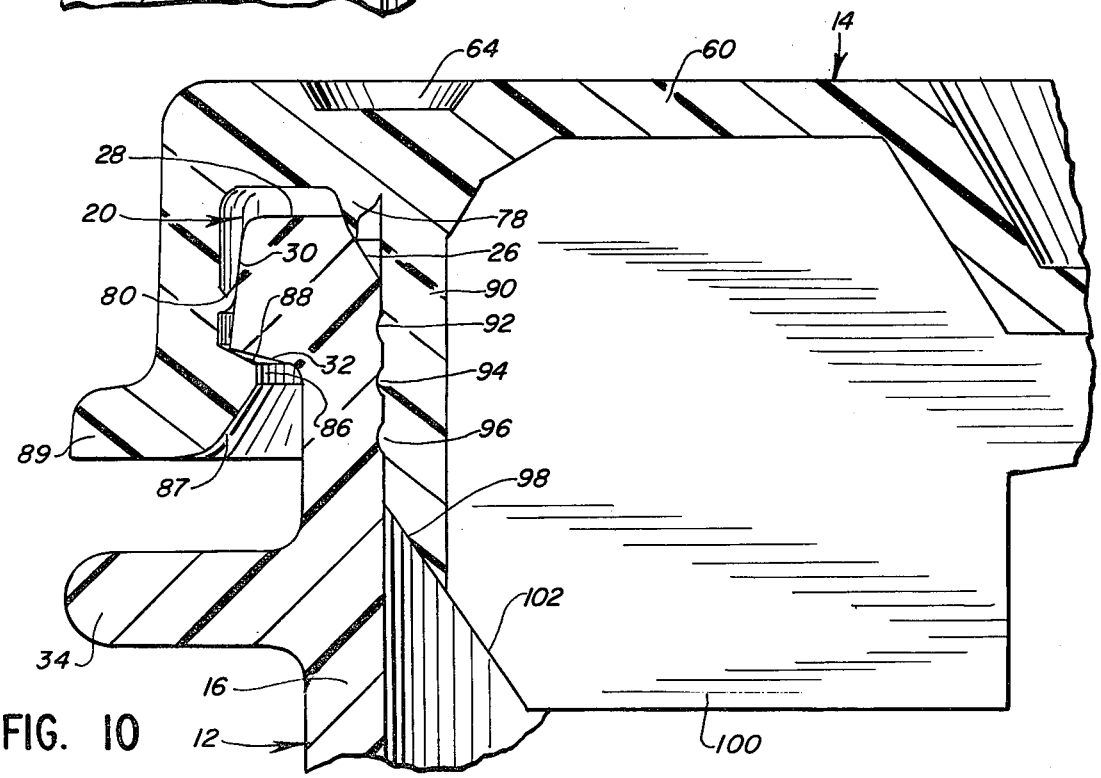
FIG. 10

CONTAINER HAVING AN INTEGRAL HANDLE AN A CLOSURE

BACKGROUND OF THE INVENTION

Paint and other like liquids have been heretofor customarily sold in metal containers. The metal containers include a vessel with a bail or handle attached to the vessel and a reuseable cover, which may be removed to expose the contents of the vessel and then reapplied to reseal the vessel. The use of plastic as a material for making containers of this general type has not been widely accepted; however, the use of such containers is known. An example of a disclosure which teaches the use of plastic for paint containers is U.S. Pat. No. 3,977,563 to Holt, entitled "Container-Lid Interlock." Though the Holt disclosure teaches the use of a bail, there is no teaching in Holt for utilizing a handle formed integral with the vessel. U.S. Pat. No. 3,730,382 to Heisler entitled, "Plastic Pail With Integral Handle and Plug-Type Plastic Cover," teaches the concept of a vessel with an integral handle. The need for an interior wall construction which fits into a vessel is taught in U.S. Pat. No. 3,532,244 to Yates entitled, "Seal For Resealable Bucket Closure," and U.S. Pat. No. 3,335,774 to Reed entitled, "Plastic Containers And Closure Members Therefor." The prior art mentioned hereinabove, shows a variety of seals, but does not disclose containers that are readily adapted for use in automatic assembly type filling of containers and applying closures. In addition, it is desirable in certain instances, to add materials to a container without removing the entire closure.

SUMMARY OF THE INVENTION

The present invention relates to an improved construction for a resealable container made of resilient plastic which is particularly adapted for holding paints and other like liquids. The container includes a molded resilient plastic vessel and a molded resilient plastic cover for removably and sealingly mounting on the vessel to close the vessel. The vessel includes a cylindrical wall; a bottom is formed integral with the cylindrical wall adjacent to one end but spaced slightly away from the other end. The opposite end of the cylindrical wall is open. A top seal defines the open end. The top seal includes a bead formed integral with the cylindrical wall. A top surface is integral with the bead. A tapered side defines the outer periphery of the bead. A lower locking face is formed integral with the bead and faces away from the open end. A handle assembly is formed integral with the outer surface of the cylindrical wall adjacent to the open end. The handle assembly includes an annular flange. A pair of abutments is formed integral with the annular flange on opposite sides of the flange. A handle has one end formed integral with one abutment and the other end formed integral with the other abutment. The handle assembly has a pair of tabs formed integral with the flange. Each of the handle tabs is positioned closer to its respective abutment than to the center of the handle. The molded resilient plastic cover includes a top having an annular groove for receiving an end of a cylindrical wall of a vessel of a like container for stacking the containers one on top of the other. A plug aperture is formed in the top and removably receives a plug. A cover seal is formed integral with the outer periphery of the top. The cover seal includes a ring wall formed integral with the top. An annular seal is formed integral with the interior surface of the top and is engageable with the top surface of the vessel to form a seal therebetween. An annular peripheral seal is formed integral with the interior surface of the ring wall and is engageable with the side of the bead of the vessel to form a seal therebetween. An annular cover bead is formed integral with the ring wall and engageable with the lower locking face of the top seal to hold the cover in engagement with the vessel. An annular wall is formed integral with the top eccentric with the ring wall having a diameter slightly less than the interior diameter of the cylindrical wall of the vessel. An annular sealing bead is formed on the outer surface of the annular wall for sealing engagement with the interior of the cylindrical wall.

BRIEF DESCRIPTION OF THE DRAWINGS

FIG. 1 is a perspective view of a vessel of the herein disclosed invention with a portion of a cover shown mounted on the vessel, the remainder of the cover is broken away in order to show clearly the construction of the vessel;

FIG. 2 is a perspective view of a portion of the vessel of FIG. 1, but showing an integral handle in a raised attitude;

FIG. 3 is an enlarged cross-sectional view taken on line 3—3 of FIG. 1 showing a portion of the vessel engaging a surface;

FIG. 4 is an enlarged partial cross-sectional view of the instant vessel and showing a portion of a mold for making the vessel;

FIG. 5 is a cross-sectional view taken on line 5—5 of FIG. 4 showing a portion of a mold for the vessel;

FIG. 6 is a cross-sectional view similar to FIG. 5 but showing the mold in an attitude for cutting off the flow of a plastic material used to make the vessel;

FIG. 7 is a plan view of the bottom or interior of the cover;

FIG. 8 is a cross-sectional view taken on line 8—8 of FIG. 7 showing the cross-sectional view of the cover and a fragmentary cross-sectional view of a vessel of a like container positioned on top of the cover;

FIG. 9 is an enlarged fragmentary cross-sectional view showing a portion of the cover and a portion of the vessel as the cover is about to engage sealingly the vessel; and FIG. 10 is an enlarged fragmentary cross-sectional view showing the cover in sealing engagement with the vessel.

DESCRIPTION OF THE PREFERRED EMBODIMENT

Referring now to the drawings, a container embodying the instant invention is shown therein. The subject container generally includes a vessel 12 shown in FIG. 1, and a cover 14 which is shown in FIG. 7. The vessel 12 and cover 14 are each integral molded resilient plastic parts, which are made of a suitable plastic such as; polypropylene or polyethylene. The cover is adapted for being removably and sealingly mounted on the vessel to seal closed the vessel.

Vessel 12 includes a cylindrical side wall 16 having a relatively thin wall. Cylindrical side wall 16 is in the form of a right circular cylinder. A bottom 18 is formed integral with side wall 16 to close one end of the side wall. Bottom 18 is spaced slightly from the end of side wall 16 as may be best seen in FIG. 8. The vessel includes a top seal 20 on the end of the side wall opposite to the end adjacent to bottom 18. A handle assembly 22 is formed integral with the side wall adjacent to the top seal.

Referring now to FIG. 7, it may be seen that top seal 20 includes a bead 24, which is formed integral with the end of side wall 16. A conical guide surface 26 is formed in the interior of side wall 16 and defines the open end of the side wall. A top face 28 defines the top of the bead and is flat. A tapered peripheral side 30 defines the other side of bead 24. Side 30 is tapered. The taper for angle "alpha" as shown in FIG. 9, is 5°. A lower locking face 32 defines the bottom of the bead.

The handle assembly 22 includes an annular flange 34, which is positioned a short distance below the top seal 20. Flange 34 has a pair of handle abutments 36 and 38 formed integral therewith. A handle 40 has one end formed integral with abutment 36 and the other end formed integral with abutment 38. The vessel is molded in a conventional injection mold. However, the portion of the mold which forms the handle contains an improvement to eliminate bubbles and weak points in the handle. The handle assembly includes a pair of handle tabs 42 and 44, which are formed integral with the flange 34, and abut the handle 40. The handle tabs 42 and 44 are generally semi-circular having the larger portion formed integral with flange 34. An indicator ear 46 is formed integral with abutment 38. The indicator ear provides a means for identifying the position of the vessel. One purpose for identifying the position of the vessel is to present the vessel in an appropriate attitude for application of a label or other identifying means to a selected portion of the vessel.

As was mentioned above, the vessel is made in a conventional injection mold having an improvement which may be best seen in FIGS. 4, 5 and 6. A portion of a mold 48 is shown therein. As may be seen in FIG. 5, the mold 48 is made up of several parts so that the vessel may be ejected from the mold. The mold contains an arcuate aperture 50 which forms handle 40. As is conventional, the molten plastic flows from the area which defines abutments 46 and 48 towards the center of aperture 50. Aperture 50 communicates with a vent 52 which in turn communicates with a vent passage 54. The vent has a piston 56 which is reciprocal in vent 52. The plastic is introduced along aperture 50 until it flows out vent 52 and into vent passage 54. An actuator 58 drives piston 56 into vent 52 thereby, closing off vent passage 54 to cut off any plastic material in vent 52 and close aperture 50 so that the plastic forming the handle is trimmed and the plastic is unable to flow out of the aperture. When the vent is opened, the gases are allowed to escape as the molten plastic travels from both sides of the aperture defining handle 40. Inasmuch as the gases and plastic contaminated with gases are allowed to escape when the molten plastic meets, there are no gases to form bubbles in the material and thereby produce a weak portion.

Cover 14 includes a circular top 60 with a cover seal 62 formed integral with the top. Top 60 includes an annular groove 64 which is particularly adapted to receive the side wall of a vessel so that like containers may be readily stacked one on top of the other. The top includes a threaded plug aperture 66 with a plug 68 removably mounted in the plug aperture. Plug 68 includes a threaded side wall 70 with a cap 72 formed integral therewith. The cap 72 has a slot 74 formed therein to receive a tool.

Cover seal 62 includes a ring wall 76 which has its upper edge formed integral with the top. An annular inner V-seal 78 is formed integral with the inner surface of the top. A peripheral V-seal 80 is formed integral with the interior wall of the ring wall and is particularly adapted for engaging tapered peripheral side 30. An annular bead or lock 82 is formed integral with the inner surface of the ring wall. The annular lock 82 includes a conical cam face 84 and an annular cylindrical face 86. The annular lock also includes an annular catch face 88, which is adapted for engagement with the face 32 of the top seal. A lip 89 is formed integral with the outer surface of the ring wall. An annular wall 90 is formed integral with the inner or lower surface of top 60. Annular wall 90 is cylindrical and is perpendicular to the top. The annular wall includes an outer annular sealing bead 92 which is formed integral with the wall. An intermediate sealing bead 94 is also formed integral with the outer surface of wall 90. An inner sealing bead 96 is also formed integral with the outer surface of the annular wall. The diameter of the annular wall is slightly less than the inside diameter of the cylindrical wall 16, so that beads 92, 94 and 96 sealingly engage the interior surface of the cylindrical wall when the cover is mounted on the top seal of vessel 12. The annular wall has a beveled edge 98 for positioning the annular wall relative to the vessel.

A plurality of locator baffels 100 is formed integral with the interior surface of the top. Each of the locator baffels 100 is perpendicular to the top and is arranged radially on the top as may be best seen in FIG. 7. Each locator baffel has a beveled edge 102 which is aligned with beveled edge 98 of the annular wall. A radial rib 104 is formed integral with each baffel 100 and is also formed integral with top 60. An inner annular wall 106 is formed integral with the top. A plurality of radial reinforcement webs 108 is formed integral with the top and extend between annular wall 90 and wall 106.

The vessel is filled with a liquid such as; paint or other liquid, and the cover is placed on the open end. It is to be noted that the cover cooperates with the vessel to seat the cover into its proper position. The beveled edges 102 of the baffels and the beveled edge 98 of the annular wall cooperates with the conical surface 26, so that any misalignment of the cover with the open end of the vessel is accommodated as a downward force is applied to the cover. As a force is applied to the cover, first the baffels direct the cover, and then the beveled edge of the annular wall directs the cover. The cam surface 84 of annular lock 82 engages the top seal. As a force is continued to be applied, the cam surface of the annular lock tends to push out the ring wall. Simultaneously, the top seal tends to be pushed in inasmuch as the cover and the vessel are resilient. As the cover moves downward, the inner annular bead 96 engages the interior surface of the cylindrical wall. Continued movement of the cover downward as viewed in FIG. 9, places the cylinder face into engagement with tapered face 30. Further movement finally has the locking face 88 pass the tapered face 30, so that the resilience of the parts causes the annular lock to snap under bead 24 and thereby, place locking face 88 into engagement with locking face 32 to hold the cover onto the vessel. As is shown in FIG. 10, it will be noted that beads 92, 94 and 96 engage the interior surface of the wall to form a seal therebetween. The V-seal 78 also engages the top seal as shown, and the peripheral seal 80 engages the tapered face 30. It may be appreciated that the cover and the vessel have seals at the three annular bead seals and the two V-seals 78 and 80.

In order to remove the cover from the vessel it is only necessary to insert a tool between flange 34 and lip 89, to pry the lock out from under the bead and thereby release the cover.

The present construction provides a further improvement in that material may be added to the container without removing the cover. In the case of paint, should it be desired to add color, it is a simple matter to insert a tool into slot 74 and turn plug 80 to remove the plug from the plug aperture. Color in an appropriate amount may be added to the contents and the plug reinserted. The plug is simply tightened with an appropriate tool without any need for removing the cover from the vessel.

With certain automatic equipment it is necessary to provide an index for the container so that a label will be applied in a desired location. Locator ear 48 provides such an index for the instant container. Ordinarily, the label is applied to the vessel while the vessel is held in a horizontal attitude. After the label is applied, the vessel is then filled with liquid and the cover is applied to seal closed the vessel.

The present container has the handle positioned in an attitude parallel to the flange so that the handle does not interfere with the handling of the container in automatic packaging machinery. The handle tabs 42 and 44 are formed in the molding process and abut the handle. Once the container is delivered to the ultimate customer and it is desired to use the handle for carrying the container, the customer need only lift the handle and the handle may be moved to an upright attitude such as that shown in FIG. 2. The handle tabs 42 and 44 are positioned closer to their respective abutments than to the center of the handle; thus, there is no rough edge which would interfere with a comfortable carrying of the container inasmuch as the tabs are positioned out of the way.

In the event that the container is accidently dropped onto a hard surface, the construction of the instant container is such that the side wall has a free portion as shown in FIG. 3, so that there is added resilience to allow the shock to be absorbed. It may be appreciated that the full container does not absorb shock as readily as the free portion of the side wall; thus, the container has a substantial degree of shock resistance. The free portion of the side wall also provides an important function of providing a foot for positioning in the stacking groove in the top so that the container may be readily stacked one on top of the other.

Although a specific embodiment of the herein disclosed invention has been described in detail above and shown in detail in the accompanying drawings, it is readily apparent that those skilled in the art may make various modifications and changes without departing from the spirit and scope of the present invention. It is to be expressly understood that the instant invention is limited only by the appended claims.

What is claimed is:

1. A container including a molded resilient plastic vessel having one end open, and a molded resilient plastic cover for removably and sealingly mounting on the open end of the vessel to close the vessel for retaining within the vessel material including liquids wherein: the molded plastic vessel includes; a circular cylindrical wall; a bottom formed integral with one end of the cylindrical wall and the opposite end of the cylindrical wall being the open end; a handle assembly having a portion formed integral with the outer surface of the cylindrical wall adjacent to the open end, said handle assembly including a handle having its opposite ends formed integral with the cylindrical wall, and a top seal formed integral with the cylindrical wall defining the open end of the cylindrical wall, said top seal including, a bead formed integral with the cylindrical wall, a top surface formed integral with the bead, a side defining the outer periphery of the bead, and a lower locking face formed integral with the bead, and said cover including; a circular top; and a cover seal formed integral with the top; said cover seal including; a ring wall formed integral with the outer periphery of the top, an annular inner seal formed integral with the interior surface of the top and being engageable with the top seal of the vessel to form a seal therebetween, an annular peripheral seal formed integral with the interior surface of the ring wall and being engageable with the side of the top seal of the vessel to form a seal therebetween, and an annular lock formed integral with the ring wall and engageable with the lower locking face of the top seal to hold the cover in engagement with the vessel.

2. A container including, a molded resilient plastic vessel having one end open, and a molded resilient plastic cover for removably and sealingly mounting on the open end of the vessel to close the vessel for retaining within the vessel material including liquids as defined in claim 1 including; a plurality of locator baffels formed integral with the top of the cover, each of said locator baffels being substantially perpendicular to the top and being arranged radially on the top, each of said locator baffels having a bevel portion engageable with the open end of the vessel for facilitating the application of the cover to the vessel.

3. A container including, a molded resilient plastic vessel having one end open, and a molded resilient plastic cover for removably and sealingly mounting on the open end of the vessel to close the vessel for retaining within the vessel material including liquids as defined in claim 1 wherein, the top of the cover includes an annular groove on its outer surface for receiving a cylindrical wall of a vessel of a like container to facilitate stacking of the containers one on top of the other.

4. A container including, a molded resilient plastic vessel having one end open, and a molded resilient plastic cover for removably and sealingly mounting on the open end of the vessel to close the vessel for retaining within the vessel material including liquids as defined in claim 1 wherein, the bottom of the vessel is spaced from the end of the cylindrical wall to provide a free portion of the cylindrical wall.

5. A container including, a molded resilient plastic vessel having one end open, and a molded resilient plastic cover for removably and sealingly mounting on the open end of the vessel to close the vessel for retaining within the vessel material including liquids as defined in claim 1 wherein, the handle assembly of the vessel has a pair of handle tabs formed integral with the cylindrical wall, each of said tabs being positioned closer to the point where the handle is formed integral with the cylindrical wall than to the center of the handle.

6. A container including, a molded resilient plastic vessel having one end open, and a molded resilient plastic cover for removably and sealingly mounting on the open end of the vessel to close the vessel for retaining within the vessel material including liquids as defined in claim 1 wherein, the top of the cover includes a plug aperture, and a plug removably mounted in the plug aperture to allow the plug to be removed to introduce materials into the container while the cover is sealingly mounted on the open end of the vessel.

7. A container including, a molded resilient plastic vessel having one end open, and a molded resilient plastic cover for removably and sealingly mounting on the open end of the vessel to close the vessel for retaining within the vessel material including liquids as defined in claim 1 wherein, the cover includes an annular wall formed integral with the top substantially perpendicular to the top for fitting into the open end of the cylindrical wall of the vessel, said annular wall having an annular sealing bead formed integral with the outer surface of the annular wall for sealing engagement with the interior of the cylindrical wall of the vessel to form a seal therebetween.

8. A container including, a molded resilient plastic vessel having one end open, and a molded resilient plastic cover for removably and sealingly mounting on the open end of the vessel to close the vessel for retaining within the vessel material including liquids as defined in claim 1 including; an annular wall formed integral with the top of the cover, said annular wall being substantialy perpendicular to the top, the free end of the annular wall having a beveled guide edge formed therein for engaging the open end of the vessel to facilitate insertion of the annular wall into the cylindrical wall.

9. A container including, a molded resilient plastic vessel having one end open, and a molded resilient plastic cover for removably and sealingly mounting on the open end of the vessel to close the vessel for retaining within the vessel material including liquids as defined in claim 1 including; a locator ear formed integral with the handle assembly and extending outward therefrom to provide an identifiable position on the vessel to position the vessel in a selected attitude.

10. A container including, a molded resilient plastic vessel having one end open, and a molded resilient plastic cover for removably and sealingly mounting on the open end of the vessel to close the vessel for retaining within the vessel material including liquids as defined in claim 1 wherein, the bottom of the vessel is spaced from the end of the cylindrical wall to define a free portion of the cylindrical wall, and the top of the cover includes an annular groove on its outer surface for receiving the free portion of the cylindrical wall of a vessel of a like container to facilitate stacking of the containers one on top of the other.

11. A container including, a molded resilient plastic vessel having one end open, and a molded resilient plastic cover for removably and sealingly mounting on the open end of the vessel to close the vessel for retaining within the vessel material including liquids as defined in claim 1 wherein, the top of the cover includes an annular groove on its outer surface for receiving a cylindrical wall of a vessel of a like container to facilitate stacking of the containers one above the other, said top of the cover includes a plug aperture within the annular groove, and a plug removably in the plug aperture to allow the plug to be removed to introduce material into the container while the cover is sealingly mounted on the open end of the vessel.

12. A container including, a molded resilient plastic vessel having one end open, and a molded resilient plastic cover for removably and sealingly mounting on the open end of the vessel to close the vessel for retaining within the vessel material including liquids as defined in claim 1 including; a plurality of locator baffels formed integral with the top of the cover, each of said locator baffels being substantially perpendicular to the top and being arranged radially on the top, and each of said locator baffels having a bevel portion engageable with the open end of the vessel for facilitating the application of the cover to the vessel, and a locator ear formed integral with the handle assembly and extending outward therefrom to provide an identifiable position on the vessel to position the vessel in a selected attitude.

13. A container including, a molded resilient plastic vessel having one end open, and a molded resilient plastic cover for removably and sealingly mounting on the open end of the vessel to close the vessel for retaining within the vessel material including liquids as defined in claim 1 including; a plurality of locator baffels formed integral with the top of the cover, each of said locator baffels being substantially perpendicular to the top and being arranged radially on the top, each of said locator baffels having a bevel portion engageable with the open end of the vessel for facilitating the application of the cover to the vessel, and said bottom of the cover being spaced from the end of the cylindrical wall to define a free portion of the cylindrical wall.

14. A container including, a molded resilient plastic vessel having one end open, and a molded resilient plastic cover for removably and sealingly mounting on the open end of the vessel to close the vessel for retaining within the vessel material including liquids as defined in claim 1 wherein, the cover includes an annular wall formed integral with the top substantially perpendicular to the top for fitting into the end of the cylindrical wall of the vessel, said annular wall having an annular sealing bead formed integral with the outer surface of the annular wall for sealing engagement with the interior of the cylindrical wall of the vessel to form a seal therebetween, and the free end of the annular wall having a bevel guide edge formed therein for engaging the open end of the vessel to facilitate insertion of the annular wall into the cylindrical wall.

15. A container including, a molded resilient plastic vessel having one end open, and a molded resilient plastic cover for removably and sealingly mounting on the open end of the vessel to close the vessel for retaining within the vessel material including liquids as defined in claim 1 wherein, the bottom of the vessel is spaced from the end of the cylindrical wall opposite the open end to define a free portion of the cylindrical wall, an annular wall formed integral with the interior surface of the top of the cover, said annular wall being substantially perpendicular to the top, said annular wall having a free end opposite the end formed integral with the top, said free end of the annular wall having a beveled guide edge formed therein for engaging the open end of the vessel for facilitating insertion of the annular wall into the cylindrical wall, and an annular sealing bead formed integral with the outer surface of the annular wall for releaseable sealing engagement with the interior of the vessel to form a seal therebetween.

16. A container including, a molded resilient plastic vessel having one end open, and a molded resilient plastic cover for removably and sealingly mounting on the open end of the vessel to close the vessel for retaining within the vessel material including liquids as defined in claim 1 including; an annular wall formed integral with the interior surface of the top of the cover, said annular wall being substantially perpendicular to the top, said annular wall having a free end, said free end of the annular wall having a beveled guide edge formed therein for engaging the open end of the vessel to facilitate insertion of the annular wall into the cylindrical wall, an annular sealing bead formed integral with the outer surface of the annular wall for sealing engagement with the interior of the cylindrical wall of the vessel to form a seal therebetween, said top of the cover including a plug aperture within the annular wall, and a plug removably mounted in the plug aperture to be removed to introduce material into the container while the cover is sealingly mounted on the open end of the vessel.

17. A container including, a molded resilient plastic vessel having one end open, and a molded resilient plastic cover for removably and sealingly mounting on the open end of the vessel to close the vessel for retaining within the vessel material including liquids as defined in claim 1 wherein, the bottom of the vessel is spaced from the end of cylindrical wall to define a free portion of the cylindrical wall, a plurality of locator baffels formed integral with the top of the cover, each of said locator baffels being substantially perpendicular to the top and being arranged radially on the top, each of said locator baffels having a bevel portion engageable with the open end of the vessel for facilitating the application of the cover to the vessel, and a pair of handle tabs formed integral with the cylindrical wall, each of said tabs being positioned closer to the point where the handle is formed integral with the cylindrical wall than to the center of the handle.

18. A container including, a molded resilient plastic vessel having one end open, and a molded resilient plastic cover for removably and sealingly mounting on the open end of the vessel to close the vessel for retaining within the vessel material including liquids as defined in claim 1 wherein, the handle assembly of the vessel has a pair of handle tabs formed integral with the cylindrical wall, each of said tabs being positioned closer to the point where the handle is formed integral with the cylindrical wall than to the center of the handle, and a plurality of locator baffels formed integral with the top of the cover, each of said locator baffels being substantially perpendicular to the top and being arranged radially on the top, and each of said locator baffels having a beveled portion being engageable with the open end of the vessel for facilitating application of the cover to the vessel.

19. A container including, a molded resilient plastic vessel having one end open, and a molded resilient plastic cover for removably and sealingly mounting on the open end of the vessel to close the vessel for retaining within the vessel material including liquids as defined in claim 1 wherein, the bottom of the vessel is spaced from the end of the cylindrical wall to define a free portion of the cylindrical wall, said handle assembly of the vessel includes a pair of handle tabs formed integral with the cylindrical wall, each of said tabs being positioned closer to the point where the handle is formed integral with the cylindrical wall than to the center of the handle, and an annular wall formed integral with the top substantially perpendicular to the top for fitting into the open end of the cylindrical wall of the vessel, and said annular wall having an annular sealing bead formed integral with the outer surface of the annular wall for sealing engagement with the interior of the cylindrical wall of the vessel to form a seal therebetween.

20. A container including, a molded resilient plastic vessel having one end open, and a molded resilient plastic cover for removably and sealingly mounting on the open end of the vessel to close the vessel for retaining within the vessel material including liquids as defined in claim 1 wherein, the cover includes an annular wall formed integral with the top substantially perpendicular to the top for fitting into the open end of the cylindrical wall of the vessel, said annular wall having an annular sealing bead formed integral with the outer surface for sealingly engaging the interior of the cylindrical wall of the vessel to form a seal therebetween, and a plurality of locator baffels formed integral with the top of the cover, each of said locator baffels being substantially perpendicular to the top and being substantially perpendicular to the annular wall, each of said locator baffels having a bevel portion engageable with the open end of the vessel for facilitating the application of the cover to the vessel.

21. A container including, a molded resilient plastic vessel having one end open, and a molded resilient plastic cover for removably and sealingly mounting on the open end of the vessel to close the vessel for retaining within the vessel material including liquids as defined in claim 1 including; an annular wall formed integral with the interior surface of the top of the cover, said annular wall being substantially perpendicular to the top, said annular wall having a free end opposite the end formed integral with the top, said free end of the annular wall having a beveled guide edge formed therein to engage the open end of the vessel to facilitate insertion of the annular wall into the cylindrical wall, an annular sealing bead formed integral with the annular wall for sealing engagement with the interior of the cylindrical wall of the vessel to form a seal therebetween, and a locator ear formed integral with the handle assembly and extending outward therefrom to provide an identifiable position of the vessel to position the vessel in a selected attitude.

22. A container including, a molded resilient plastic vessel having one end open, and a molded resilient plastic cover for removably and sealingly mounting on the open end of the vessel to close the vessel for retaining within the vessel material including liquids as defined in claim 1 including; an annular wall formed integral with the top of the cover, said annular wall being substantially perpendicular to the top, said annular wall having its end away from the top free, said free end having a beveled guide edge formed therein, and a plurality of locator baffels formed integral with the top of the cover, each of said locator baffels being substantially perpendicular to the top, each of said locator baffels being formed integral with the annular wall and being substantially perpendicular to the annular wall where each locator baffel is formed integral with the annular wall, each of said locator baffels having a bevel portion, the annular wall having a beveled guide edge formed therein being aligned with the bevel portion of the locator baffels to facilitate insertion of the annular wall into the cylindrical wall.

23. A container including, a molded resilient plastic vessel having one end open, and a molded resilient plastic cover for removably and sealingly mounting on the open end of the vessel to close the vessel for retaining within the vessel material including liquids as defined in claim 1 wherein, the handle assembly of the vessel includes a pair of handle tabs formed integral with the cylindrical wall, each of said tabs being positioned closer to the point where the handle is formed integral with the cylindrical wall than to the center of the handle, an annular wall formed integral with the interior of the top, said annular wall being substantially perpendicular to the top, said annular wall having a free end opposite the end formed integral with the top, a beveled guide edge formed integral in the free end of the annular wall for engaging the open end of the vessel to facilitate insertion of the annular wall into the cylindrical wall, and an annular sealing bead formed integral with the outer surface of the annular wall for sealingly engagement with the interior of the cylindrical wall of the vessel to form a seal therebetween.

24. A container including, a molded resilient plastic vessel having one end open, and a molded resilient plastic cover for removably and sealingly mounting on the open end of the vessel to close the vessel for retaining within the vessel material including liquids as defined in claim 1 wherein, the top of the cover includes an annular groove on its outer surface for receiving a cylindrical wall of a vessel of a like container to facilitate stacking of the containers one above the other, an annular wall formed integral with the interior surface of the top of the cover, said annular wall being substantially perpendicular to the top, said annular wall having a free end opposite the end formed integral with the top, said free end of the annular wall having a beveled guide edge formed thereon for engaging the open end of the vessel to facilitate insertion of the annular wall into the cylindrical wall, and said annular wall having an annular sealing bead formed integral with the outer surface of the annular wall for sealing engagement with the interior of the cylindrical wall of the vessel to form a seal therebetween.

25. A container including, a molded resilient plastic vessel having one end open, and a molded resilient plastic cover for removably and sealingly mounting on the open end of the vessel to close the vessel for retaining within the vessel material including liquids as defined in claim 1 including; an annular wall formed integral with the top of the cover, said annular wall being substantially perpendicular to the top, said annular wall having a free end opposite to the end formed integral with the top, the free end of the annular wall having a beveled guide edge formed therein for engaging the open end of the vessel to facilitate insertion of the annular wall into the cylindrical wall, an annular sealing bead formed integral with the outer surface of the annular wall for sealing engagement with the interior of the cylindrical wall of the vessel to form a seal therebetween, the bottom of the vessel is spaced from the end of the cylindrical wall to define a free portion of the cylindrical wall, the top of the cover includes an annular groove in its outer surface for receiving the free portion of a cylindrical wall of a vessel of a like container to facilitate stacking of the containers one above the other.

26. A container including, a molded resilient plastic vessel having one end open, and a molded resilient plastic cover for removably and sealingly mounting on the open end of the vessel to close the vessel for retaining within the vessel material including liquids as defined in claim 1 wherein, the cover includes an annular wall formed integral with the top substantially perpendicular to the top for fitting into the open end of the cylindrical wall of the vessel, said annular wall having an annular sealing bead formed integral with the outer surface for sealing engagement with the interior of the cylindrical wall of the vessel to form a seal therebetween, and a plurality of locator baffels formed integral with the top of the cover, each of said locator baffels being substantially perpendicular to the top, each of said baffels formed integral with the annular wall and being substantially perpendicular to the annular wall at the point where the baffel is formed integral with the annular wall, said annular wall having a beveled guide edge formed therein, each of said locator baffels having a bevel portion aligned with the beveled guide edge of the annular wall for facilitating the application of the cover to the vessel.

27. A container including, a molded resilient plastic vessel having one end open, and a molded resilient plastic cover for removably and sealingly mounting on the open end of the vessel to close the vessel for retaining within the vessel material including liquids as defined in claim 1 wherein, the bottom of the vessel is spaced from the end of the cylindrical wall to define a free portion of the cylindrical wall, the top of the cover includes an annular groove on its outer surface for receiving a cylindrical wall of a vessel of a like container to facilitate stacking of the containers one above the other, said top of the cover includes a plug aperture within the annular groove, a plug removably mounted in the plug aperture to allow the plug to be removed to introduce material into the container while the cover is sealingly mounted on the open end of the vessel, an annular wall formed integral with the interior surface of the top of the cover, said annular wall being substantially perpendicular to the top, said annular wall having a free end, said annular wall having a beveled guide edge formed therein for engaging the open end of the vessel to facilitate insertion of the annular wall into the cylindrical wall, and an annular sealing bead formed integral with the outer surface of the annular wall for sealing engagement with the interior of the cylindrical wall of the vessel to form a seal therebetween.

28. A container including, a molded resilient plastic vessel having one end open, and a molded resilient plastic cover for removably and sealingly mounting on the open end of the vessel to close the vessel for retaining within the vessel material including liquids as defined in claim 1 wherein, the bottom of the vessel is spaced from the end of the cylindrical wall to define a free portion of the cylindrical wall, the handle assembly includes a pair of handle tabs formed integral with the cylindrical wall, each of said tabs being positioned closer to the point where the handle is formed integral with the cylindrical wall than to the center of the handle, the cover includes an annular wall formed integral with the top substantially perpendicular to the top and adapted for fitting into the open end of the cylindrical wall of the vessel, an annular sealing bead formed integral with the outer surface of the annular wall for sealing engagement with the interior of the cylindrical wall of the vessel to form a seal therebetween, a plurality of locator baffels formed integral with the top of the cover, each of said locator baffels being substantially perpendicular to the top, each of said locator baffels having one edge formed integral with the annular wall and being substantially perpendicular to the wall, each of said locator baffels having a bevel portion, and said annular wall having a beveled guide edge formed thereon and being aligned with the bevel portion of the locator baffels, said beveled guide edge of the annular wall and the bevel portions of the locator baffels being engageable with the open end of the vessel for facilitating the application of the cover to the vessel.

29. A container including, a molded resilient plastic vessel having one end open, and a molded resilient plastic cover for removably and sealingly mounting on the open end of the vessel to close the vessel for retaining within the vessel material including liquids as defined in claim 1 wherein, the handle assembly includes a pair of handle tabs formed integral with the cylindrical wall, each of said tabs being positioned closer to the point where the handle is formed integral with the cylindrical wall than to the center of the handle, an annular wall formed integral with the top of the cover, said annular wall being substantially perpendicular to the top and having a diameter slightly less than the interior diameter of the cylindrical wall of the vessel, an annular sealing bead formed integral with the outer surface of the annular wall for sealing engagement with the interior of the cylindrical wall of the vessel to form a seal therebetween, a plurality of locator baffels formed integral with the top of the cover, each of said locator baffels being substantially perpendicular to the top, each of said locator baffels being formed integral with the annular wall and being substantially perpendicular to the annular wall, each of said locator baffels having a bevel portion, and said annular wall having a beveled guide edge formed thereon and being aligned with the bevel portion of the baffels for engaging the open end of the vessel to facilitate insertion of the annular wall into the cylindrical wall for application of the cover to the vessel.

30. A container including, a molded resilient plastic vessel having one end open, and a molded resilient plastic cover for removably and sealingly mounting on the open end of the vessel to close the vessel for retaining within the vessel material including liquids as defined in claim 1 including; a locator ear formed integral with the handle assembly and extending outward therefrom to provide an identifiable position on the vessel to position the vessel in a selected attitude, said handle assembly including a pair of handle tabs formed integral with the cylindrical wall, each of said tabs being positioned closer to the point where the handle is formed integral with the cylindrical wall than to the center of the handle, said bottom of the vessel being spaced from the end of the cylindrical wall to define a free portion of the cylindrical wall, the top of the cover includes an annular groove on its outer surface for receiving the free end of the cylindrical wall of a vessel of a like container to facilitate stacking of the containers one above the other, the top of the container includes a plug aperture, a plug removably mounted in the plug aperture to allow the plug to be removed to introduce material into the container while the cover is sealingly mounted on the open end of the vessel, an annular wall formed integral with the top of the cover, said annular wall being substantially perpendicular to the top, said annular wall having a diameter slightly less than the inside diameter of the cylindrical wall to allow the annular wall to fit inside the cylindrical wall of the vessel, an annular sealing bead formed integral with the outer surface of the annular wall for sealing engagement with the interior of the cylindrical wall of the vessel to form a seal therebetween, a plurality of locator baffels formed integral with the top of the cover, each of said locator baffels being substantially perpendicular to the top, each of said locator baffels being formed integral with the annular wall and being substantially perpendicular to the annular wall, each of said locator baffels having a bevel portion, and the annular wall having a beveled guide edge formed thereon and being aligned with the bevel portion of the locator baffels, whereby said bevel portion of the locator baffels and the beveled guide edge cooperate to engage the open end of the vessel to facilitate insertion of the annular wall into the cylindrical wall for the application of the cover to the vessel.

31. A molded resilient plastic vessel comprising; a cylindrical wall, a bottom formed integral with one end of the cylindrical wall to close the bottom, and a curved elongated handle having opposite ends formed integral with the cylindrical wall, said handle being formed in a mold wherein plastic material flows from each end of the handle towards the center and a vent is contained at the center to allow gases to escape, and the vent is subsequently closed to complete the handle.

32. A container including, a molded resilient plastic vessel having a right circular cylindrical wall, a bottom formed integral with and adjacent to one end of the cylindrical wall to close that end of the cylindrical wall, said bottom being spaced away from the end of the cylindrical wall to form a free end, a top seal formed integral with the other end of the cylindrical wall defining an open end of the cylindrical wall, said top seal including a bead formed integral with the cylindrical wall, a top surface formed integral with the bead, a conical surface defining the outermost portion of the open end and contacting the top surface, a tapered side defining the outer periphery of the bead, a lower locking face formed integral with the bead and extending away from the open end, a handle assembly formed integral with the outer surface of the cylindrical wall adjacent to the open end, said handle assembly including a flange formed integral with the exterior surface of the side wall, a pair of handle abutments formed integral with the flange and being positioned on opposite sides of the flange, a locator ear formed integral with one of the abutments, said locator ear extending outward to provide an identifiable position on the vessel to position the vessel in a selected attitude, a handle having its opposite ends formed integral with the abutments, a pair of handle tabs formed integral with the flange and being positioned closer to the abutments than to the center of the handle; and a cover for removably and sealingly mounting on the open end of the vessel to close the vessel for retaining within the vessel materials including liquids, said cover including a circular top, said top having an annular groove in its outer surface for receiving a cylindrical wall of a vessel of a like container to facilitate stacking of the containers one on top of the other, a plug aperture in the center of the top, said plug aperture having a thread, a threaded plug removably mounted in the plug aperture to allow the plug to be removed to introduce materials into the container while the cover is sealingly mounted on the open end of the vessel, said plug having a slot in its center for receiving a tool to turn the plug, a ring wall formed integral with the outer periphery of the top, an annular interior seal formed integral with the interior surface of the top and being engageable with the top surface of the vessel to form a seal therebetween, an annular peripheral seal formed integral with the interior surface of the ring wall and being engageable with the tapered side of the bead of the vessel to form a seal therebetween, an annular bead formed integral with the ring wall, said annular bead having a cam face engageable with the side of he bead of the vessel, a cylindrical face abutting the cam face, a locking face abutting the cylindrical face engageable with the lower locking face of the bead of the vessel to hold the cover onto the vessel, said ring wall having an outwardly extending lip being positionable adjacent to the flange of the vessel, an annular wall formed integral with the top inside the ring wall, said annular wall being substantially perpendicular to the top, a plurality of annular sealing beads formed integral with the outer surface of the annular wall for sealing engagement with the interior of the cylindrical wall of the vessel to form seals therebetween, a plurality of locator baffels formed integral with the top cover within the annular wall, each of said locator baffels being substantially perpendicular to the top and being arranged radially on the top, each of said baffels being formed integral with the annular wall, each of said baffels having a bevel portion, and said annular wall having a beveled guide edge formed thereon and aligned with the bevel portions of the locator baffels for engaging the conical surface of the open end of the vessel to facilitate insertion of the annular wall into the cylindrical wall for application of the cover to the vessel.

* * * * *

UNITED STATES PATENT OFFICE

CERTIFICATE OF CORRECTION

PATENT NO. : 4,380,304

DATED : April 19, 1983

INVENTOR(S) : George C. Anderson

It is certified that error appears in the above-identified patent and that said Letters Patent are hereby corrected as shown below:

On the title page

Following the last line of the Abstract, Add;

-- The cover seal includes a ring wall formed integral with the outer periphery of the top. An annular inner seal is formed integral with the top for engagement with the vessel. An annular wall seal is formed integral with the interior surface of the ring wall and is sealingly engageable with the side of the bead of the top seal of the vessel. The cover seal includes an annular bead formed integral with the lower locking face of the vessel top seal for holding the cover onto the vessel.--

Signed and Sealed this

*Fifth* Day of *July 1983*

[SEAL]

*Attest:*

GERALD J. MOSSINGHOFF

*Attesting Officer*

*Commissioner of Patents and Trademarks*